United States Patent [19]

Kawabata

[11] 4,127,082

[45] Nov. 28, 1978

[54] WIPER ROLLER FOR DRYING A WET SHEET IN A COPYING MACHINE

[75] Inventor: Nobuo Kawabata, Nara, Japan

[73] Assignee: Sharp Kabushiki Kaisha, Osaka, Japan

[21] Appl. No.: 726,232

[22] Filed: Sep. 24, 1976

[30] Foreign Application Priority Data

Sep. 26, 1975 [JP] Japan ..... 50-117971
Jan. 20, 1976 [JP] Japan ..... 51-6437

[51] Int. Cl.[2] ..... G03G 15/10

[52] U.S. Cl. ..... 118/652; 118/104; 118/662

[58] Field of Search ..... 118/651, 652, 659-662, 118/118, 104, 244, 223; 354/318; 68/202

[56] References Cited

U.S. PATENT DOCUMENTS

| | | | |
|---|---|---|---|
| 1,955,414 | 4/1934 | Dickhaut | 118/118 |
| 3,249,088 | 5/1966 | Ostensen | 118/662 |
| 3,251,338 | 5/1966 | Hornberger et al. | 118/118 |
| 3,304,910 | 2/1967 | Warner | 118/118 |
| 3,312,191 | 4/1967 | Lowe | 118/104 |
| 3,368,526 | 2/1968 | Matsumoto et al. | 118/662 |
| 3,384,051 | 5/1968 | Hunstiger | 118/662 |
| 3,596,635 | 8/1971 | Smitzer | 118/651 |
| 3,643,628 | 2/1972 | Sugarman et al. | 118/662 X |
| 3,696,785 | 10/1972 | Andrus | 118/652 |
| 3,744,452 | 7/1973 | Savit et al. | 118/662 X |
| 3,769,896 | 11/1973 | Samuels et al. | 118/104 X |
| 3,784,297 | 1/1974 | Ito et al. | 118/652 X |
| 3,820,891 | 6/1974 | Kurakawa et al. | 118/662 X |
| 3,893,416 | 7/1975 | Eichorn | 118/652 |
| 3,911,174 | 10/1975 | Rose | 118/104 X |
| 3,921,580 | 11/1975 | Kase | 118/659 X |
| 3,929,096 | 12/1975 | Thettu | 118/104 X |
| 3,955,533 | 5/1976 | Smith et al. | 118/652 |
| 3,999,510 | 12/1976 | Thettu | 118/104 X |

*Primary Examiner*—Werner H. Schroeder
*Assistant Examiner*—Andrew M. Falik
*Attorney, Agent, or Firm*—Birch, Stewart, Kolasch and Birch

[57] ABSTRACT

A wiper roller made of rubber, plastics or metal is rotatably installed in such a manner as to come into contact with a wet sheet having passed through a liquid developing section in a copying machine. The wiper roller is driven to rotate at a peripheral speed faster than the transportation velocity of the wet sheet or is driven to rotate in a counter direction to the transportation direction of the wet sheet in order to remove excess moisture held by the wet sheet.

25 Claims, 6 Drawing Figures

WIPER ROLLER FOR DRYING A WET SHEET IN A COPYING MACHINE

BACKGROUND OF THE INVENTION

The present invention relates to a drying means for removing excess moisture held by a wet sheet which has passed through a liquid developing section in a copying machine.

In prior art, drying means for removing excess moisture held by a wet sheet which has passed through a liquid developing section in a copying machine such as an electrophotographic duplicating apparatus and an electrostatic recording apparatus, a knife edge, wringing rollers, a suction fan or a blower has been used.

However, the above-mentioned knife edge, wringing rollers, suction fan or blower are not effective when they are used alone. An effective combination comprises a knife edge and a blower. However, a knife edge is not suited for a sheet having a plurality of holes formed therein, such as a sprocket driven sheet, because the knife edge will catch the hole formed in the sheet.

The suction fan is not suited as a drying means, because it is almost impossible to extract the excess moisture held by the wet sheet. Therefore, the blower is usually provided in addition to the suction fan.

The wringing rollers are most effective to dry the wet sheet. The wringing rollers are usually installed not only for removing the excess moisture held by the wet sheet but also for driving the sheet in a certain direction. The wringing rollers are installed in a fashion to traverse the wet sheet and to come into contact with the whole surface of the wet sheet. This will cause a meandering drive or an inclined drive of the sheet.

It has also been proposed to provide a rotatable drying roller adjacent to a photosensitive drum in a copying machine. In this example, the rotatable drying roller is installed apart from the surface of the photosensitive drum a distance of about 0.1 to 0.2 mm in order to protect the drum surface from being damaged. Therefore, the moisture will unavoidably remain on the drum surface with a thickness of 0.1 to 0.2 mm.

OBJECTS AND SUMMARY OF THE INVENTION

Accordingly, an object of the present invention is to provide a drying means for drying a wet sheet.

Another object of the present invention is to provide a drying means for drying a wet sheet which has passed through a liquid developing section of a copying machine.

Still another object of the present invention is to provide a drying means for drying a wet sheet without damaging the surface of the wet sheet.

Yet another object of the present invention is to provide a wiper roller for drying a wet sheet which has passed through a liquid developing section in a copying machine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a wiper roller made of rubber, plastics or metal is rotatably installed in such a manner as to come into contact with a wet sheet which has passed through a liquid developing section in a copying machine. The wiper roller is driven to rotate at a peripheral speed faster than the transportation velocity of the wet sheet, and in a preferred form at a peripheral speed of three times the transportation velocity of the wet sheet. The wiper roller is also driven to rotate in a counter direction to the transportation direction of the wet sheet, thereby removing excess moisture held by the wet sheet.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
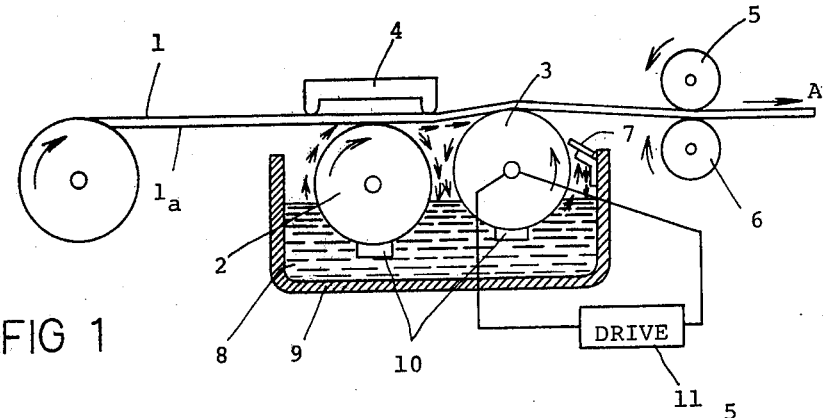
FIG. 1 is a sectional view of a developing and drying section of a copying machine employing an embodiment of a wiper roller of the present invention.

FIG. 1 shows an embodiment of a developing and drying section of the present invention employed in an electrostatic copying machine, wherein the latent image forming section is omitted from the drawing for the purpose of simplicity.

Developer liquid 8 is contained within a liquid developer reservoir 9. A developing roller 2 and a wiper roller 3 are rotatably installed above the liquid developer reservoir 9 in such a manner that a portion of the developing roller 2 and the wiper roller 3 is dipped into the developer liquid 8. A copy sheet 1 is driven to travel in a direction shown by an arrow A through the use of a driving roller 5 and a pinch roller 6. A depression means 4 is provided above the developing roller 2 for depressing the copy sheet 1 against the developing roller 2, thereby creating a good contact between the developing roller 2 and a surface 1*a* of the copy sheet 1 upon which a latent image has been formed. A cleaning pad 7 made of elastic material such as rubber is provided in such a manner as to come into contact with the wiper roller 3 at the outlet site of the sheet transportation. Sweeping members 10 are provided below the developing roller 2 and the wiper roller 3 in order to sweep the respective rollers.

Developer liquid 8 in the liquid developer reservoir 9 is maintained at a predetermined level through the use of a liquid developer supplying means (not shown). The developer liquid 8 is transported toward the surface 1*a* of the copy sheet 1 by virtue of the rotation of the developing roller 2, thereby developing the latent image formed on the copy sheet surface 1*a*.

The wiper roller 3 is rotatably installed to come into contact with the copy sheet surface 1*a*, and is driven to rotate at a constant velocity in a counter direction to the copy sheet transportation direction through the use of a driving means 11. The cleaning pad 7 functions to prevent the supply of the developer liquid 8 to the copy sheet surface 1*a* via the wiper roller 3. The wiper roller 3 is preferably driven to rotate at a peripheral speed three times the transportation velocity of the copy sheet 1. The uppermost portion of the wiper roller 3 is dry by virtue of the provision of the cleaning pad 7 and, therefore, excess moisture held by the copy sheet 1 passed through the developing section is completely removed during the rotation of the wiper roller 3 and recovered into the liquid developer reservoir 9.

In the foregoing embodiment, the excess moisture is removed by virtue of the rotation of the wiper roller 3 and, therefore, the drying means of the present invention is applicable to any sheet even having holes formed therein. Moreover, the present drying means is suited not only for the wet sheet but also any sheet material such as film. The wiper roller 3 can, alternatively, be provided outside the liquid developer reservoir 9.

The wiper roller 3 can be made of rubber, plastics or metal. When the present drying means is used to dry the copy sheet having a developed image of the latent image an electrophotographic duplicating machine, the wiper roller 3 is preferably made of metal. In the foregoing embodiment, the wiper roller 3 is driven to rotate in a counter direction to the copy sheet transportation, but the wiper roller 3 can be driven to rotate in the same direction as the copy sheet transportation but at the peripheral speed faster than the travelling velocity of the copy sheet 1.

FIGS. 2 through 5 show other examples of the wiper roller 3 of the present invention.

Figure 2:
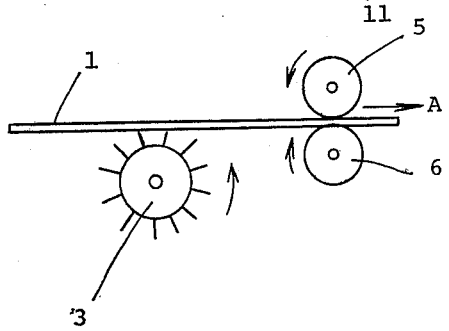
FIG. 2 is a sectional view of another embodiment of a wiper roller of the present invention.
Figure 3:
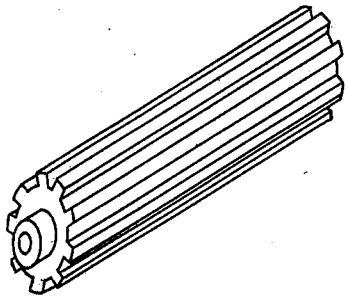
FIG. 3 is a perspective view of still another embodiment of a wiper roller of the present invention.
Figure 4:
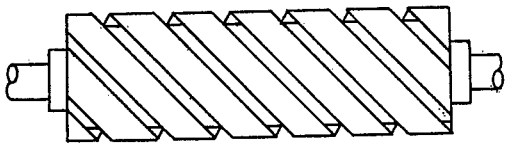
FIG. 4 is a plan view of yet another embodiment of a wiper roller of the present invention.
Figure 5:
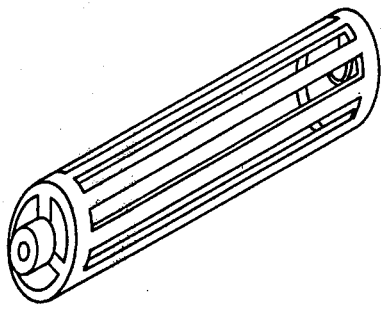
FIG. 5 is a perspective view of a further embodiment of a wiper roller of the present invention.

In the example of FIG. 2, a plurality of radially standing bristles made of elastic materials such as plastics are formed on the wiper roller 3. A plurality of grooves can be formed on the surface of the wiper roller in a fashion parallel to the shaft of the wiper roller as shown in the embodiment of FIG. 3. A plurality of spiral grooves can be formed on the surface of the wiper roller as shown in the embodiment of FIG. 4. In the embodiment of FIG. 5, the wiper roller is a hollow cylinder and has a plurality of slits parallel to the shaft of the wiper roller.

Figure 6:
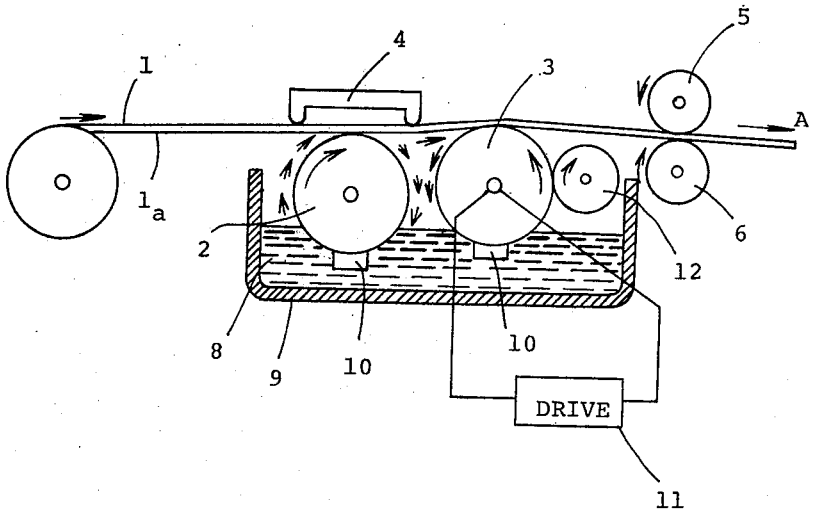
FIG. 6 is a sectional view of a developing and drying section of a copying machine employing another embodiment of a drying means of the present invention.

FIG. 6 shows another embodiment of a developing and drying section of the present invention employed in an electrostatic copying machine. Like elements corresponding to those of FIG. 1 are indicated by like numerals.

A cleaning roller 12 made of elastic material such as plastics is rotatably installed in such a manner as to come into contact with the wiper roller 3 at the outlet site of the sheet transportation, thereby preventing the transfer of the developer liquid 8 to the copy sheet surface 1*a* via the wiper roller 3.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A developing and drying means for an electrostatic copying machine wherein a copy sheet is driven to travel at a constant velocity in a certain direction comprising:

a liquid developer reservoir for containing developer liquid therein;

a developing roller rotatably installed in such a manner as to come into contact with the copy sheet, the developing roller being disposed within the liquid developer reservoir in such a manner that a portion of the developing roller becomes submerged in the developer liquid during the rotation of the developer roller;

a wiper roller rotatably disposed in such a manner as to come into contact with the copy sheet on the downstream side of the developing roller, the wiper roller being provided within the liquid developer reservoir so that only a portion of the wiper roller becomes submerged in developing liquid during the rotation of the wiper roller;

a driving means for rotating the wiper roller at a constant velocity in the counter direction to the travelling direction of the wet sheet; and a cleaning means disposed to come into contact with the wiper roller in order to clean the wiper roller during the rotation thereof.

2. The developing and drying means of claim 1, wherein the wiper roller has a cylinder shape and is made of metal.

3. The developing and drying means of claim 1, wherein the wiper roller has a plurality of radially extending bristles formed on the surface of the wiper roller.

4. The developing and drying means of claim 3, wherein the bristles are made of a plastic material.

5. The developing and drying means of claim 1, wherein the wiper roller has a plurality of grooves formed on the surface of the wiper roller and extending substantially parallel to the shaft of the wiper roller.

6. The developing and drying means of claim 1, wherein the wiper roller has a plurality of spiral grooves formed on the surface of the wiper roller.

7. The developing and drying means of claim 1, wherein the driving means drives the wiper roller at a peripheral speed about three times the travelling velocity of the copy sheet.

8. The developing and drying means of claim 1, wherein the cleaning means comprises a cleaning pad made of rubber and positioned at the outlet side of the developer reservoir.

9. The developing and drying means of claim 1, wherein the cleaning means comprises a rotatable cleaning roller made of a plastic material and positioned at the outlet side of the developer reservoir.

10. The developing and drying means of claim 9, wherein the cleaning roller is rotatable in a counter direction to that of the wiper roller.

11. The developing and drying means for an electrostatic copying machine wherein a copy sheet is driven to travel at a constant velocity in a predetermined direction which comprises:

a liquid developer reservoir disposed on one side of the travelling copy sheet and adapted to contain a developer liquid therein;

a developer roller rotatably disposed in such a manner so that a portion of the developer roller contacts the copy sheet and another portion thereof extends into the developer liquid disposed within the developer reservoir;

a wiper roller rotatably disposed in such a manner so that a portion of the wiper roller contacts the same side of the copy sheet, adjacent to and on the downstream side of the developing roller, another portion of the wiper roller extending into the developing liquid;

driving means for rotating the wiper roller at a constant velocity in the opposite direction to the travelling direction of the wet copy sheet and at a peripheral speed greater than the travelling velocity of the wet copy sheet; and a cleaning means disposed to come into contact with the wiper roller in order to clean the wiper roller during the rotation thereof.

12. The developing and drying means of claim 11, wherein the cleaning means comprises a cleaning pad made of rubber and positioned at the outlet side of the developer reservoir.

13. The developing and drying means of claim 11, wherein the cleaning means comprises a rotatable cleaning roller made of a plastic material and positioned at the outlet side of the developer reservoir.

14. The developing and drying means of claim 11, wherein a depression means is operatively associated with the developer roller and on the opposite of the copy sheet from the developer roller, said depression means maintaining contact between the copy sheet and the developer roller.

15. A drying means for removing excess moisture held by a wet sheet which is driving to travel at a constant velocity in a certain direction comprising:

a wiper roller rotatably installed to come into contact with the wet sheet, said wiper roller comprising a hollow cylinder with a shell having a plurality of substantially parallel slits; and driving means for rotating the wiper rollers at a constant velocity in the counter direction to the travelling dirction of the wet sheet.

16. A drying means for removing excess moisture held by a wet sheet which is driven to travel at a constant velocity in a certain direction comprising:

a wiper roller rotatable installed to come into contact with the wet sheet, said wiper roller comprising a hollow with a shell having a plurality of substantially parallel slits; and a driving means for rotating the wiper roller at a constant peripheral speed faster than the travelling velocity of the wet sheet.

17. A developing and drying means for an electrostatic copying machine wherein a copy sheet is driven to travel at a constant velocity in a predetermined direction which comprises:

a liquid developer reservoir disposed at one side of the travelling copy sheet and adapted to contain a developer liquid therein;

a developer roller rotatably disposed in such a manner so that a portion of the developer roller contacts the copy sheet and another portion thereof extends into the developer liquid disposed within the developer reservoir;

a wiper roller rotatably disposed in such a manner so that a portion of the wiper roller contacts the same side of the copy sheet, adjacent to and on the downstream side of the developing roller;

driving means for rotating the wiper roller in a counter direction and at a peripheral speed greater than the travelling velocity of the copy sheet; and a cleaning means disposed to come into contact with the wiper roller in order to clean the wiper roller during the rotation thereof.

18. The developing and drying means of claim 17, wherein said driving means rotates the wiper roller at a constant velocity.

19. The developing and drying means of claim 18, wherein the cleaning means comprises a cleaning pad made of rubber.

20. The developing and drying means of claim 18, wherein the cleaning means comprises a rotatable cleaning roller made of a plastic material.

21. The developing and drying means of claim 18, wherein a depression means is operatively associated with the developer roller and on the opposite side of the copy sheet from the developer roller, said depression means maintaining contact between the copy sheet and the developer roller.

22. The developing and drying means of claim 17, wherein the wiper roller has a plurality of radially extending bristles formed on the surface of the wiper roller.

23. The developing and drying means of claim 22, wherein the bristles are made of a plastic material.

24. The developing and drying means of claim 17, wherein the wiper roller has a plurality of grooves formed on the surface of the wiper roller and extending substantially parallel to the shaft of the wiper roller.

25. The developing and drying means of claim 17, wherein the wiper roller has a plurality of spiral grooves formed on the surface of the wiper roller.

* * * * *